US006820563B2

(12) United States Patent
D'Urbino et al.

(10) Patent No.: US 6,820,563 B2
(45) Date of Patent: Nov. 23, 2004

(54) TABLE WITH FLAPS HINGED THERETO AND MANEUVERABLE BY MEANS OF ANGULAR MOVEMENTS OF THE TABLE TOP

(76) Inventors: Donato D'Urbino, Via Teodisio, 67-20131 Milan (IT); Paolo Lomazzi, Corso Plebisciti, 1-20129 Milan (IT)

( * ) Notice: Subject to any disclaimer, the term of this patent is extended or adjusted under 35 U.S.C. 154(b) by 0 days.

(21) Appl. No.: 10/250,839

(22) PCT Filed: Jan. 3, 2002

(86) PCT No.: PCT/IT02/00001

§ 371 (c)(1),
(2), (4) Date: Oct. 27, 2003

(87) PCT Pub. No.: WO02/052984

PCT Pub. Date: Jul. 11, 2002

(65) Prior Publication Data

US 2004/0069191 A1 Apr. 15, 2004

(30) Foreign Application Priority Data

Jan. 5, 2001 (IT) ..... FI2001A0003

(51) Int. Cl.[7] ..... A47B 1/04
(52) U.S. Cl. ..... 108/77
(58) Field of Search ..... 108/77, 80, 82, 108/81, 79, 78

(56) References Cited

U.S. PATENT DOCUMENTS

| | | | | | |
|---|---|---|---|---|---|
| 185,219 | A | * | 12/1876 | Cutler | 108/79 |
| 331,084 | A | * | 11/1885 | Pohl et al. | 108/80 |
| 357,506 | A | * | 2/1887 | Slater | 108/80 |
| 1,043,567 | A | * | 11/1912 | Burnham | 108/77 |
| 1,623,850 | A | * | 4/1927 | Patenaude | 108/79 |
| 1,993,787 | A | * | 3/1935 | Howe | 108/77 |
| 2,187,423 | A | * | 1/1940 | Hyland | 108/77 |
| 2,301,563 | A | | 11/1942 | McFall | |
| 2,602,716 | A | * | 7/1952 | Muth | 108/77 |
| 2,730,416 | A | * | 1/1956 | Williams | 108/77 |

FOREIGN PATENT DOCUMENTS

| | | |
|---|---|---|
| DE | 149 732 | 7/1903 |
| DE | 296 11 493 | 10/1996 |
| GB | 399 118 | 9/1933 |

* cited by examiner

*Primary Examiner*—Jose V. Chen
(74) *Attorney, Agent, or Firm*—McGlew and Tuttle, P.C.

(57) ABSTRACT

A table (10) is angularly mobile on an vertical rotation axis (X—X) with respect to a fixed base (1, 3); an articulated rod 16) forming a strut is articulated by means of end ball joints (18, 20) both under the flap (12) and to a support (14) of the base (1,3) at a distance from the axis (X—X) of angular mobility of the table; the flap is raised when the table is turned in one direction and the same flap is lowered when the table is turned in the opposite direction.

14 Claims, 10 Drawing Sheets

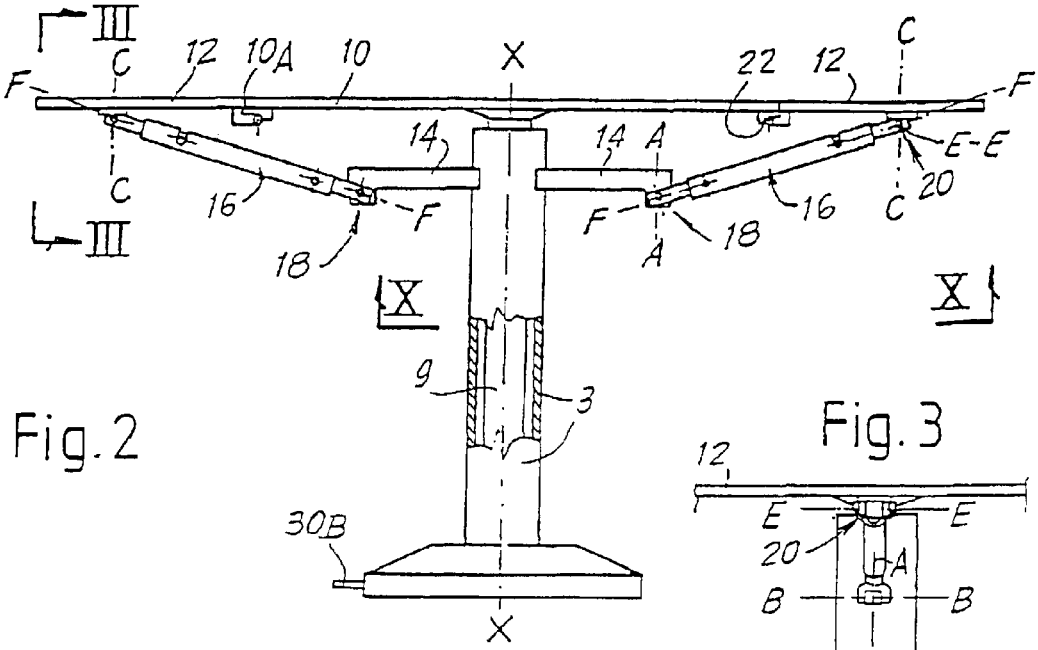
Fig. 2
Fig. 3
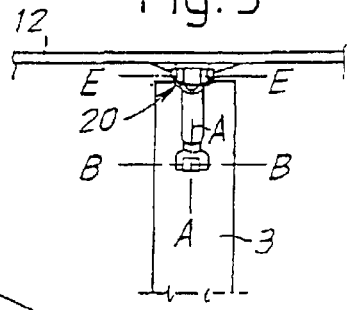
Fig. 1
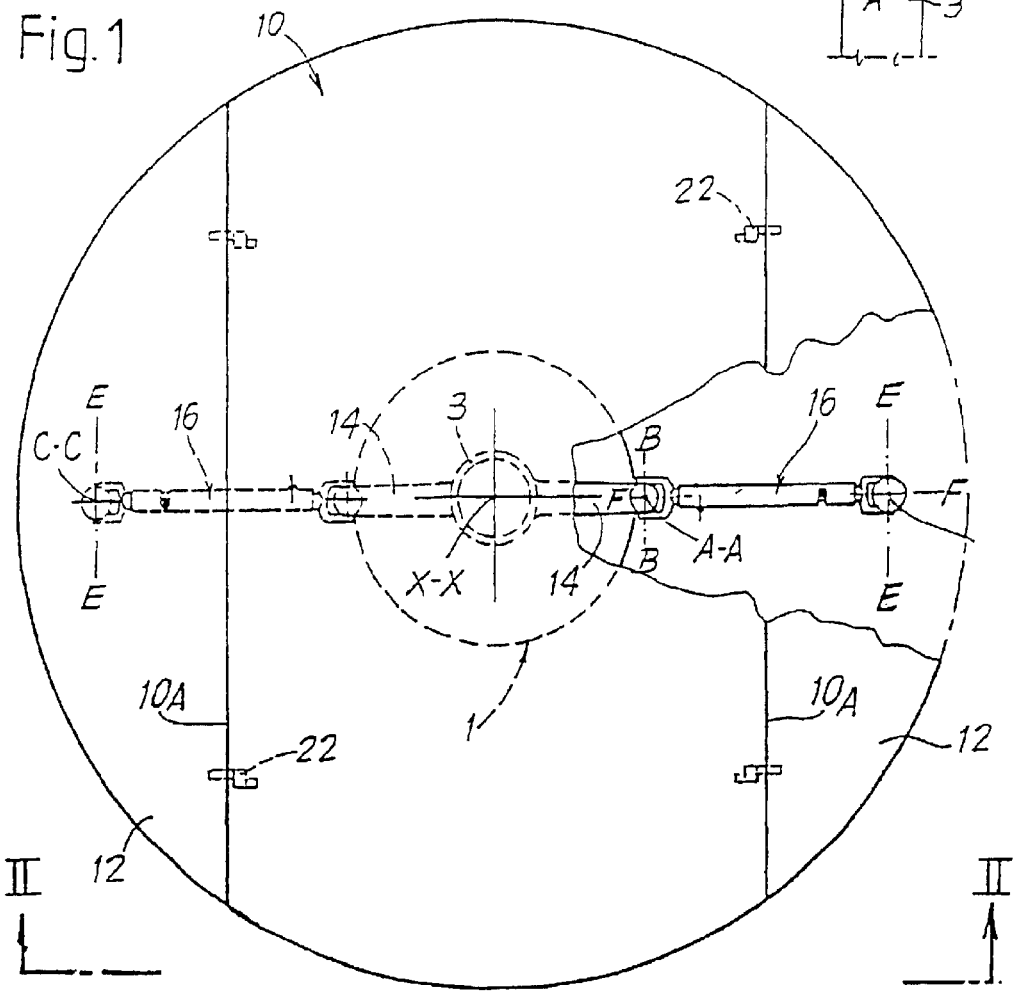

TABLE WITH FLAPS HINGED THERETO AND MANEUVERABLE BY MEANS OF ANGULAR MOVEMENTS OF THE TABLE TOP

The invention relates to a table susceptible of being extended with a simple, rapid operation; particularly, the table presents at least one or two flaps, or even four flaps, hinged thereto and susceptible of being lowered or raised to be coplanar with the table.

This and other objects and advantages will be illustrated in the following description and in the accompanying drawing.

The table herein described is mobily and angularly mounted on a vertical rotation axis with respect to a fixed base. An articulated rod forms the strut and is articulated on ball joints under the or each flap at a distance from the hinge connecting the flap to the table and to a support of the base at a distance from the mobile angular axis of the table; furthermore, means are provided to fasten the flap or by each flap at least in the raised position to the level of the table. By turning the table in one direction, the ball joint connecting the flap is distanced from said rotation axis and raises the flap, while by turning the table in the opposite direction, said joint moves closer to said rotation axis and the flap is lowered.

In a practical embodiment, the articulated rod, or each of the articulated rods, presents a joint of the cardan type on each of the two ends, with two crossed joint axes and a coaxial joint to the rod itself.

More specifically, each cardan joint can comprise one axis orthogonal to the flap which is respectively orthogonal to the table top and an axis which is orthogonal to the previous axis and orthogonal to the axis of the rod.

More simply, nut-ball joints can be used.

Fastening means can comprise a column, which is solidly fastened to the table top and internal to the base, presenting a sector profile with two notches cooperating with a fastening device, which is connected to the base and can be advantageously operated by pedal. Said fastening device can elastically rest on said sector profile and clip into either one or the other of the two end of stroke housings in either direction, whereby defining a coplanar position of the flap with respect to the table and a position of exclusion. Said fastening device can be arranged to stop the table in a position of exclusion, in which the flap or the flaps are slanted downwards towards the column in a position which does not hinder a person sitting at the table arranged in reduced configuration.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIGS. 1, 2 and 3 illustrate a table with two flaps in extended configuration, in plan view, with parts removed, according to view II—II in FIG. 1 and to view III—III in FIG. 2;

DESCRIPTION OF THE PREFERRED EMBODIMENTS

Figure 4:
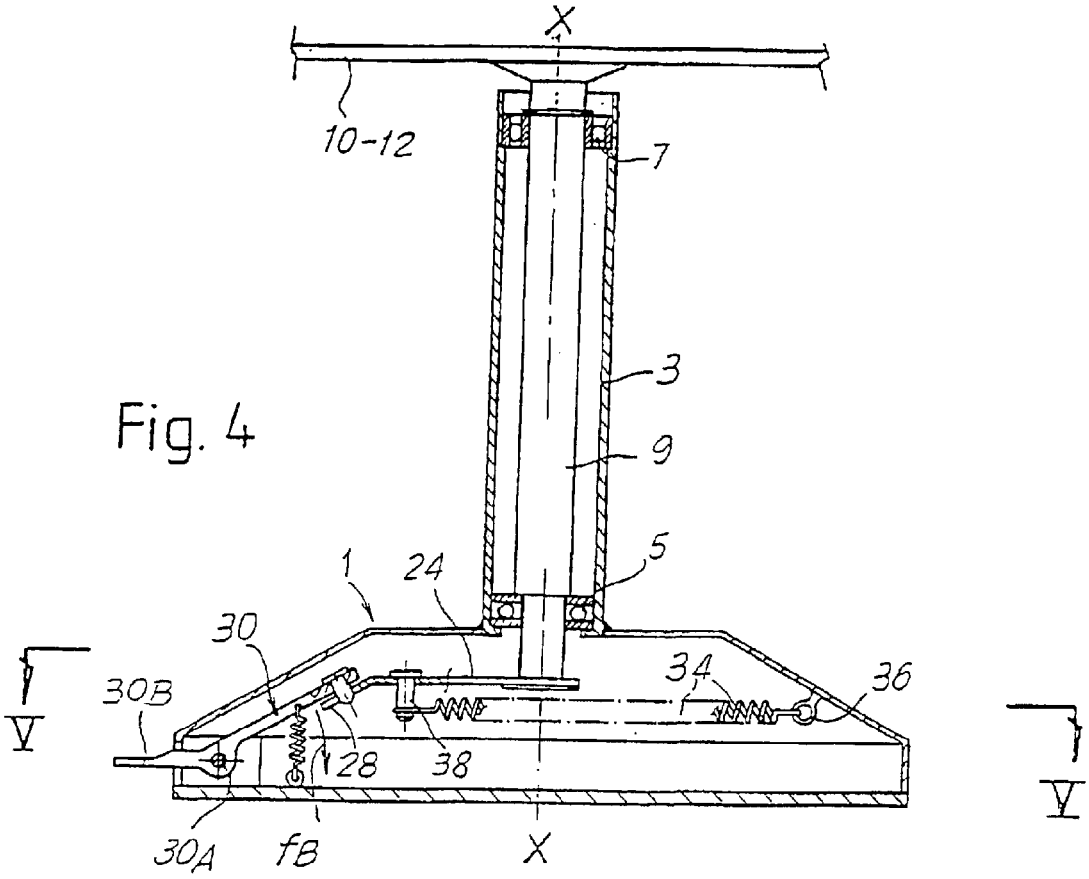
FIGS. 4 and 5 illustrate a detail of the table in vertical section and in a section according to V—V in FIG. 4.
Figure 5:
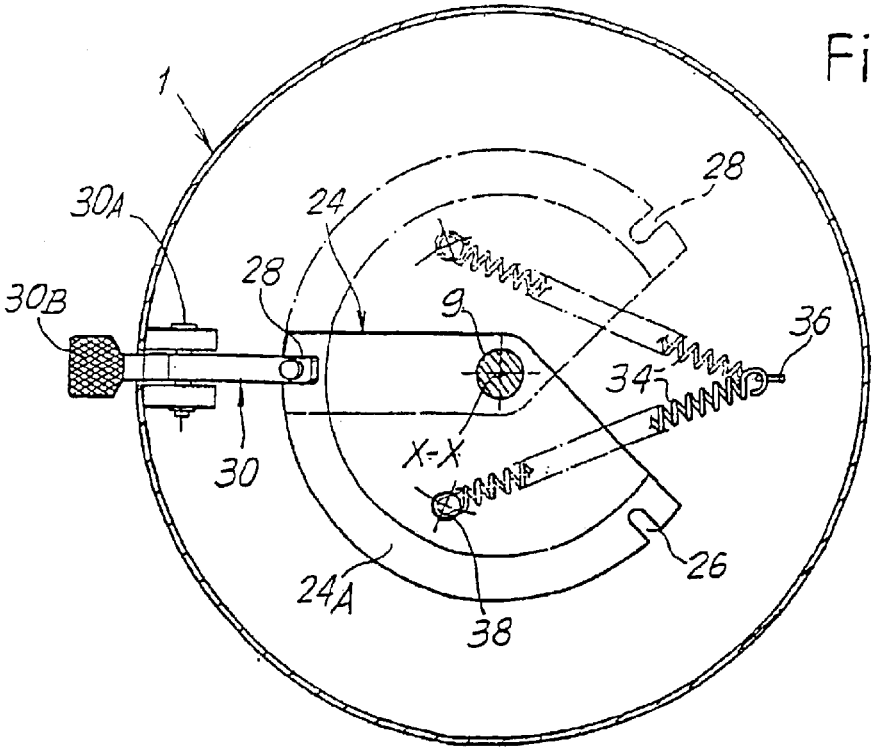
Figure 7:
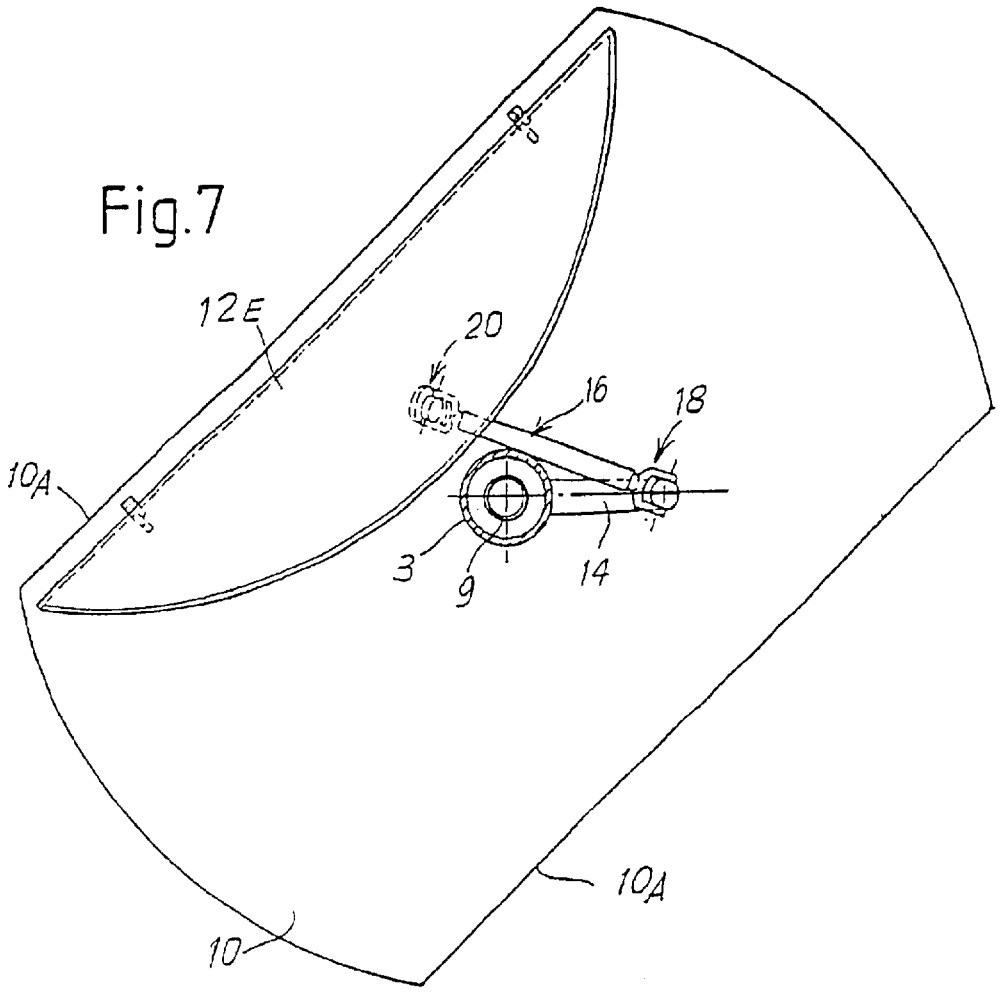
FIGS. 6 and 7 illustrate a lateral view and sectional view according to the line VII—VII in FIG. 6 of the table with a single flap shown in reduced configuration.
Figure 6:
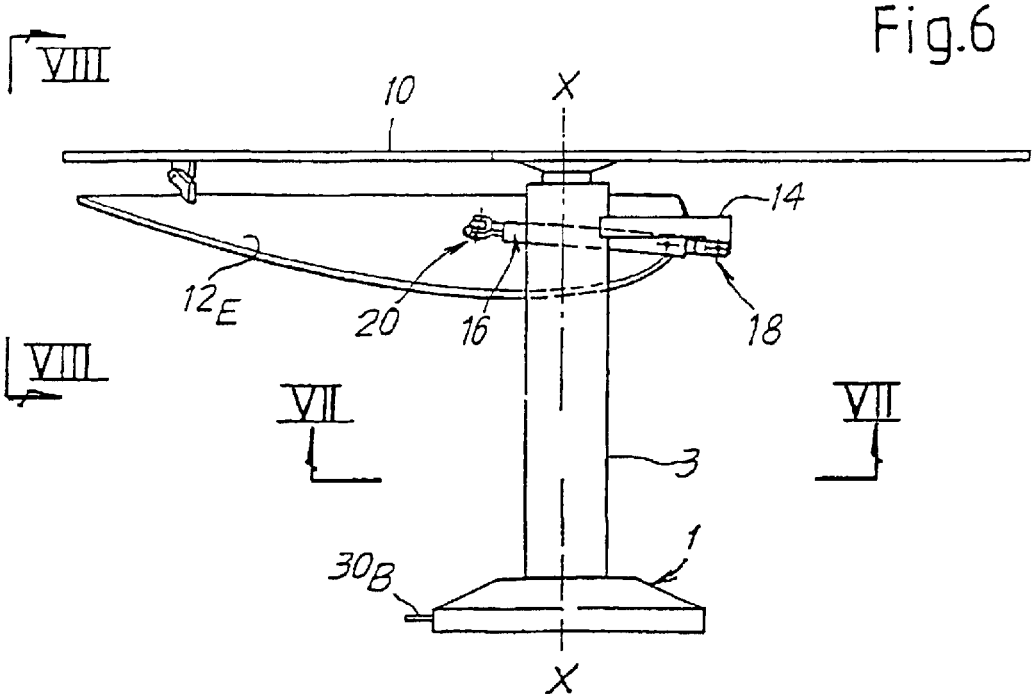
Figure 8:
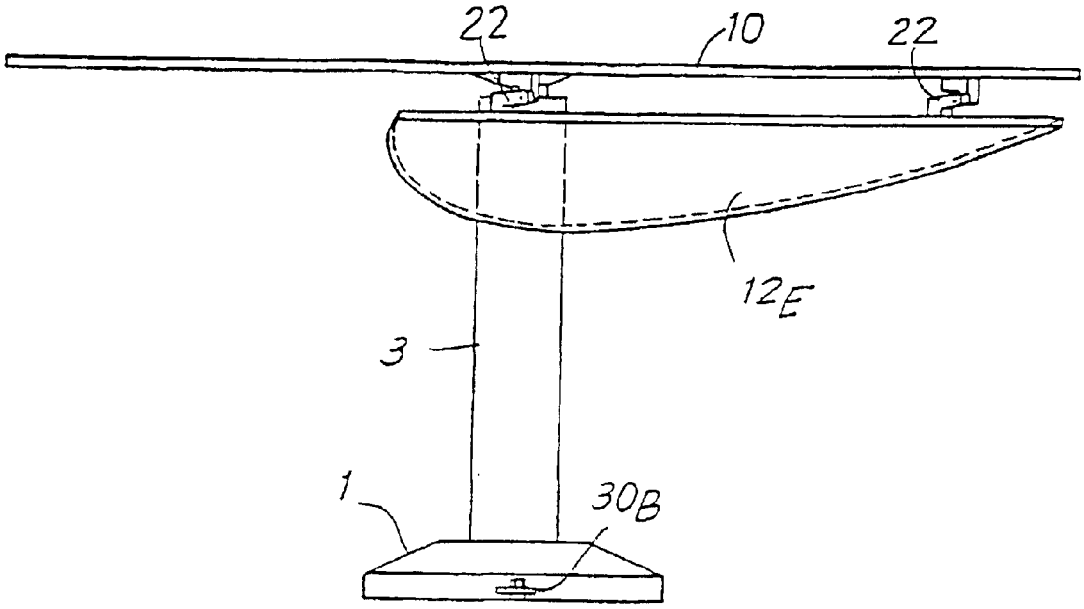
FIGS. 8 and 9 illustrate a view according to VIII—VIII in FIG. 6 and a raised view with the flaps in position of exclusion.
Figure 9:
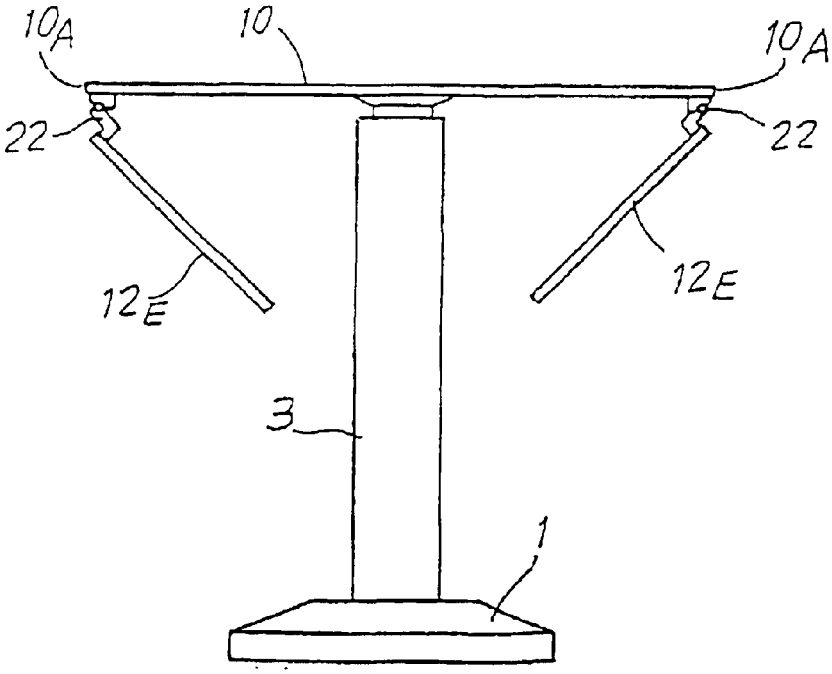

FIGS. 1 through 9 in the annexed drawing illustrate the example of a circular table with two flaps in the reduced and extended configuration. Numeral 1 indicates a base for the table from which a riser 3 develops whose form is essentially tubular. The whole is fixed in position. A vertical column 9 is housed inside the riser 3 by means of bearings 5 and 7 and turns on an axis X—X. The table top 10 is solidly fastened to the column 9 and forms the minimum portion of usable surface of the table; the table top 10 presents two parallel sides 10A and two curved sides 10B, which can be part of a circular top, which is completed when the two flaps 12, articulated along the sides 10A of the table top 10, are raised. In the table provided with two flaps 10A shown here, the riser 3 presents two opposite supports 14 orthogonally developing with respect to the sides 10A and under the top of the table 10. The table can be provided with a single flap 12 articulated on a straight side 10A, while the second flap 12 can either be absent or replaced by a fixed extension of the table with a minimum surface.

An articulated strut rod, generally indicated with numeral 16, is arranged between each support 14 and respective flap 12. Said rod 16 is ball jointed in 18 to the support 14 and in 20 under the flap 12, by means of a ball joint also in the latter case. The ball joint 18 is limitedly distanced from the axis X—X and the ball joint 20 is limitedly distanced from the axis of the hinge 22 of the flap 12, developing parallelly and adjacently under the respective side 10A of the table.

Figure 10:
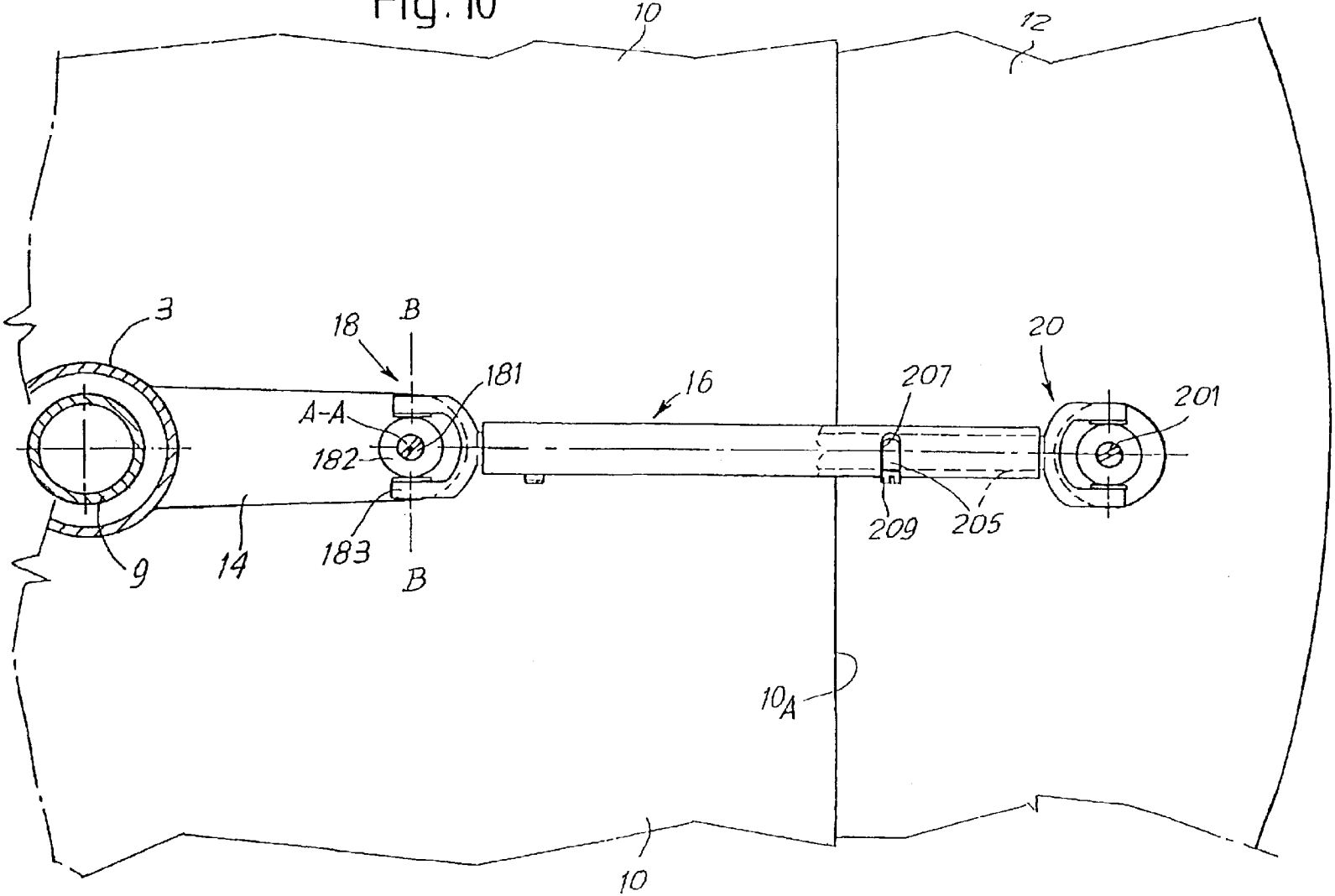
FIGS. 10 and 11 illustrate two views and a partial section of a solution with an articulated rod for operating a flap.
Figure 11:
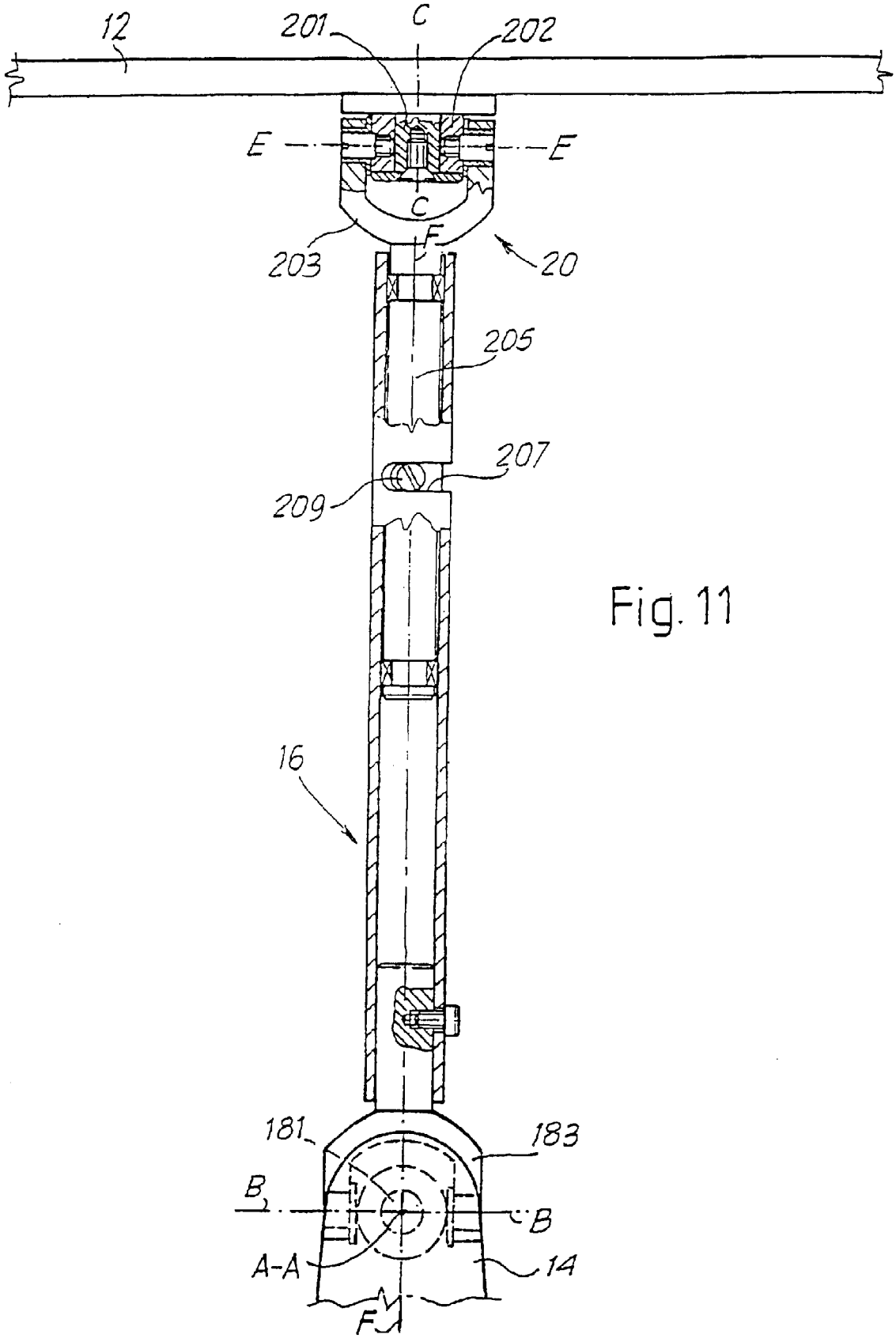

Each rod 16—as shown in detail in FIGS. 10 and 11—can be provided with two ball joints 18 and 20 made as described below, with particular reference to joint 18. An intermediate element 182 is fastened under the support 14 by means of a vertical pin 181 defining a vertical articulation axis A—A and can turn on the axis A—A. A fork 183, belonging to the rod 16, is articulated on a horizontal axis B—B to the intermediate element 182. The second ball joint 20, provided on the opposite end of the rod 16, comprises a pin 201, which is orthogonal to the plane of the flap 12, identifying a rotation axis C—C orthogonal to the flap and engaging an intermediate element 202 onto which, in turn, a second fork 203 is articulated according to an axis E—E, parallel to the plane of the flap 12. The second fork 203 is similar to the fork 103 and belongs to the rod 16. The two forks 183 and 203 are susceptible of turning with respect to each other on an axis F—F, which is developed along the flap 16 and which preferably crosses the crossing point of the axes A—A and B—B and crosses the crossing point of the axes C—C and E—E. Practically, one of the forks, 203 in the drawing, is solidly fastened to a spindle 205, withheld and turning in an axial housing of the rod 16. The angular stroke of the spindle is limited by a slot 207 in which a peg 209 solidly fastened to the spindle 205 projects and prevents axial stroke. According to this arrangement, the ends of the rod, or each rod, 16 are articulated to two points which are respectively distanced from axis X—X and from the axis of articulation of the flap 12, corresponding to a side 10A of the table.

The described arrangement—providing the possibility of rotating the table top 10 on the axis X—X along with the column 9 supporting and guiding it and with the strut rod 16 articulated in 18 and 20 to the support 14 respectively to each flap 12—each flap 12 can be moved between a position which is aligned and coplanar with the top 10 and a position of exclusion under the table top 10 with the simple rotation of the table top on the axis X—X. This is because, considering FIG. 1, the flap 12 is supported by the strut made by the rod 16 in the conditions in which the horizontal projection of the rod 16 is essentially aligned with the support 14 in the conditions in which the axes X—X, A—A and C—C are on a vertical geometrical plane. The flap 12 is thus kept coplanar to the top 10. By turning the top 10 on the axis X—X to take it from the position in FIGS. 1 to 3 to the position in FIGS. 6, 7, 8 and 9, each rod 16 is driven by the ball joint 20 on the ball joint 18 and is taken from the position shown in FIG. 1 to the position shown in FIG. 7, simply by turning the table top 10. In the terminal conditions shown in FIG. 7 and FIG. 9, the rods 16 draw the flaps on which they are articulated moving downwards to the position of exclusion in which each flap 12 assumes the position indicated with numeral 12E in FIGS. 6 through 9. These movements are ensured by the joints, which are arranged on the ends of the strut rods 16 in the way described around the crossing points of the axes A—A, B—B and F—F of joint 18 and of the axes C—C and E—E and F—F of the joint 20 or around the center of the corresponding nut-ball joints.

The two positions of use of each flap 12—in condition of coplanarity with the top 10 (FIG. 2) and in condition of exclusion in the configuration indicated with numeral 12E (FIG. 9)—are simply obtained by angularly moving the table top 10 on the axes X—X and fastening it in the two obtained positions. An advantageous solution for fastening it that of the arrangement described hereof.

A sector profile 24, with a circumferential edge 24A whose center is on the axis X—X of the rotation column 9 of the table top 10, is solidly fastened to said column 9 on the lower end of the column 9 inside the base 1. The sector 24 presents two notches 26 and 28 (see FIG. 5 for details) towards its ends. The two notches 26 and 28 are angularly and reciprocally distanced by an angle Z, which corresponds to the angle by which the top 10 must turn to move the flap, or each flap, from the coplanar position to the exclusion position and vice versa. A fastening device 30 carried by the base 1 cooperates with the two notches 26 and 28. The fastening device can be developed as a rocker arm lever (also see FIG. 4) articulated in 30A and with a part 30B projecting in the form of a pedal to be comfortably operated by whom imposes the rotation of the table to the table itself. The rocker arm lever 30 is elastically stressed in the direction to be lowered according to the arrow fB, which corresponds to a stress imposed on the fastening device 30 in a direction to penetrate either one or the other of the notches 26 and 28 so to fasten the equipment consisting of the sector 24, the column 9 and the top 10 in the angular position. In the extended configuration of the table, with the flaps 12 coplanar to the top 10, the fastening device 30 penetrates in the notch 26 and fastens the rotation of the table when the flaps 12 have reached the coplanar position with the table itself. By pressing the pedal 30B (against the elastic action in the direction fB), the equipment 24, 9 and 10 is released and the flaps can be returned and lowered. The flaps are fastened by the penetration of the fastening device 30 in the notch 28. Oppositely, by releasing the sector 24 from the constraint of the notch 28, the fastening device 30 permits the reversed rotation, i.e. raising the flaps.

Particularly the operation of raising the flaps (and partially the operation of lowering the flaps and of approaching the flaps to the riser 3 in the configuration of exclusion 20E) requires a certain effort to overcome the gravity due to the weight of the respective flaps. In order to facilitate the two operations of raising the flaps to the coplanar configuration with the top 10 and of approaching the flaps to the riser 3 with a downwards slant from the horizontal configuration to the slanted position towards the riser 3, a spring 34 can be provided under the sector 24, anchored in point 36 to the base and in point 38 to the sector 24; the spring 34 is a traction-operated spring, which consequently recalls the sector 24 in one direction and the other from a neutral position, i.e. a dead point, overcoming which the sector 24 is stressed in either direction to reach the end of stroke position and consequently lock the fastening device 30. The action of the spring 34 is exerted in the second part of the angular movement of the table and consequently when the flaps must be raised in the coplanar configuration of the table 10 or in the slanted exclusion configuration indicated by number 12E. In this way, the action of the spring facilitates the operation made by the person maneuvering the table.

Since the fastening device 30 is elastically biased in order to engage one or the other of the notches 26 and 28, after pushing the pedal 30A for unlocking, and after starting the angular maneuver around axis X—X of the table 10, the column 9 and the sector 24, the pedal can be released. The device 30 comes to rest along the angular profile 24A such that the fastening device 30 is caused to resiliently rest on said edge 24A until it reaches the notch (26 or 28) which defines the desired locking position.

Consequently, each operation simply requires raising the fastening device 30 by pressing the pedal 30B after which the fastening operation is completed by clipping without the need of additional operations by the operator except for the angular shift of the equipment of the table 10, the column 9 and the sector 24.

Figure 12:
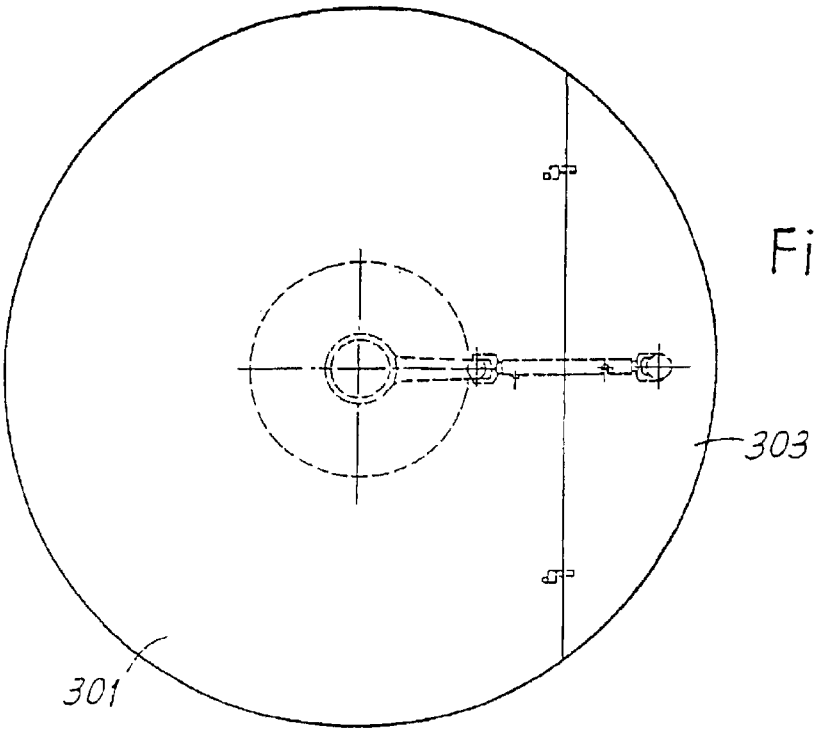
FIGS. 12, 13 and 14 illustrate in plan view two solutions with one flap and one solution with two flaps.
Figure 13:
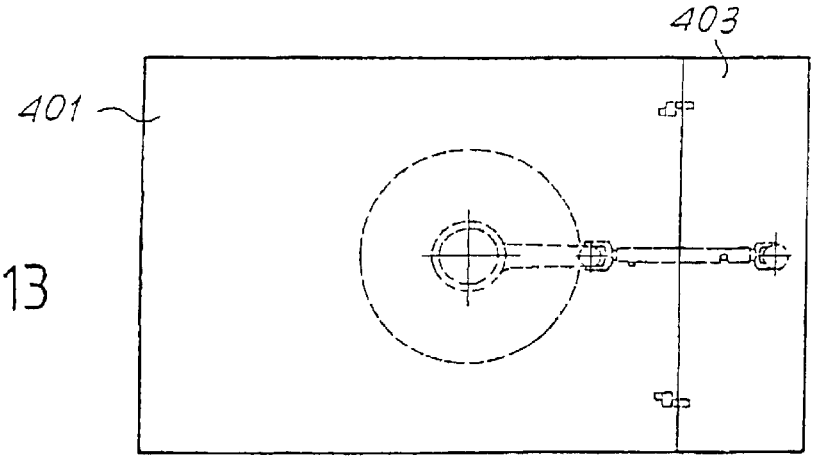
Figure 14:
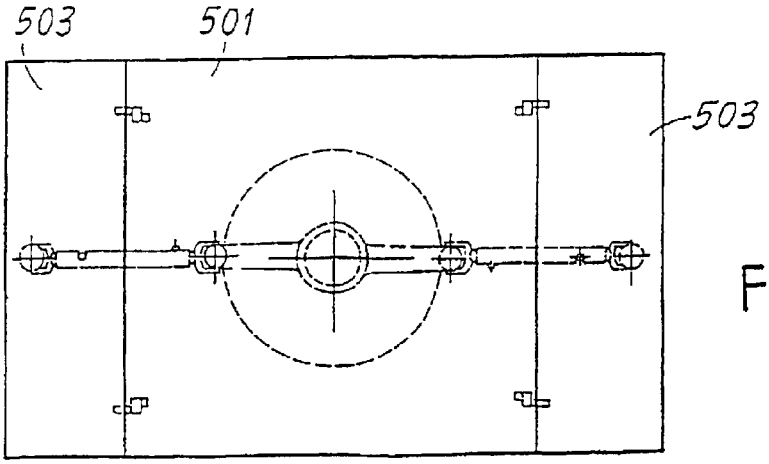
Figure 15:
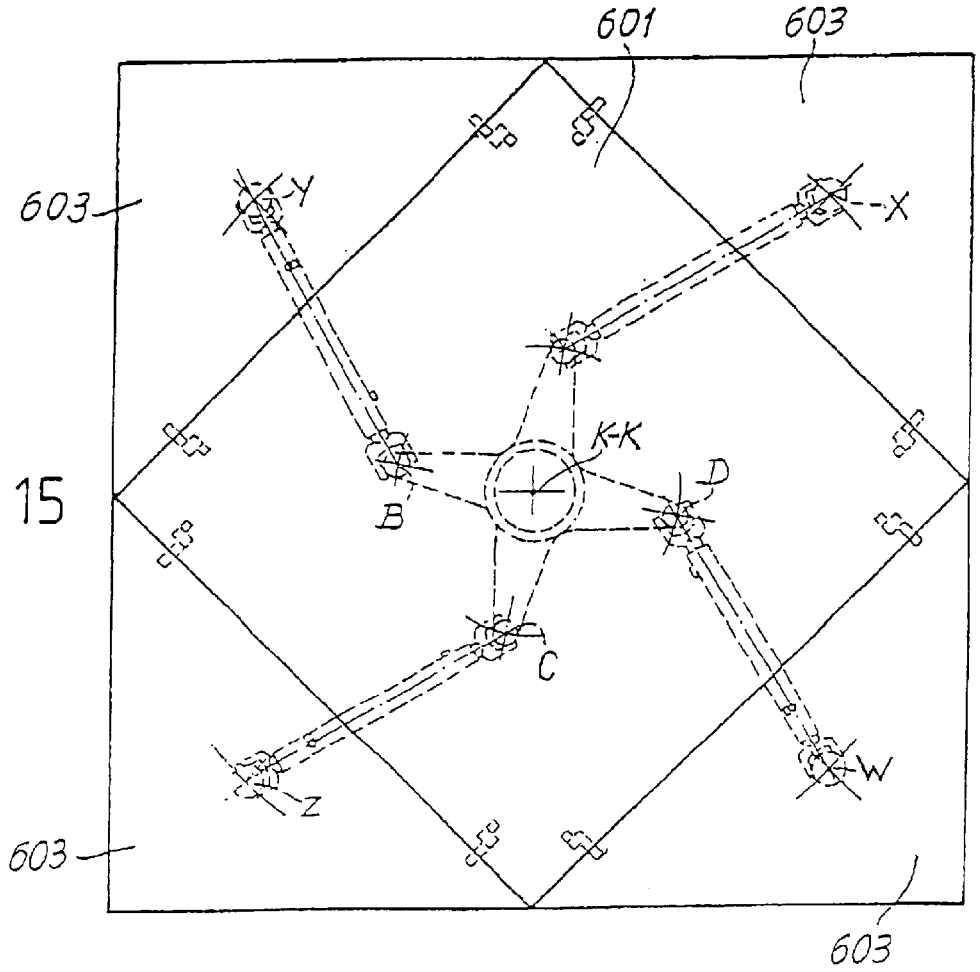
FIGS. 15 and 16 illustrate a plan view of a square table with four triangular flaps in the extended configuration and in the reduced configuration.
Figure 16:
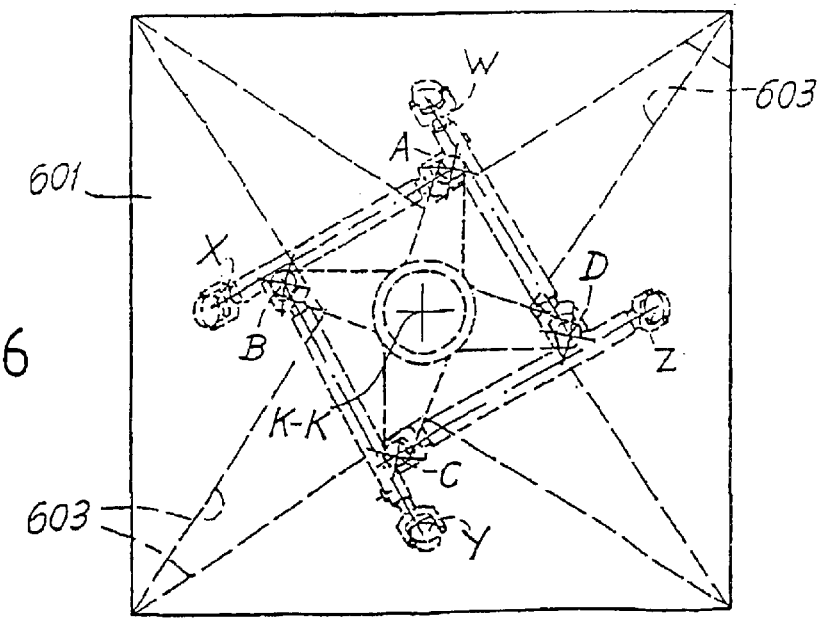
Figure 17:
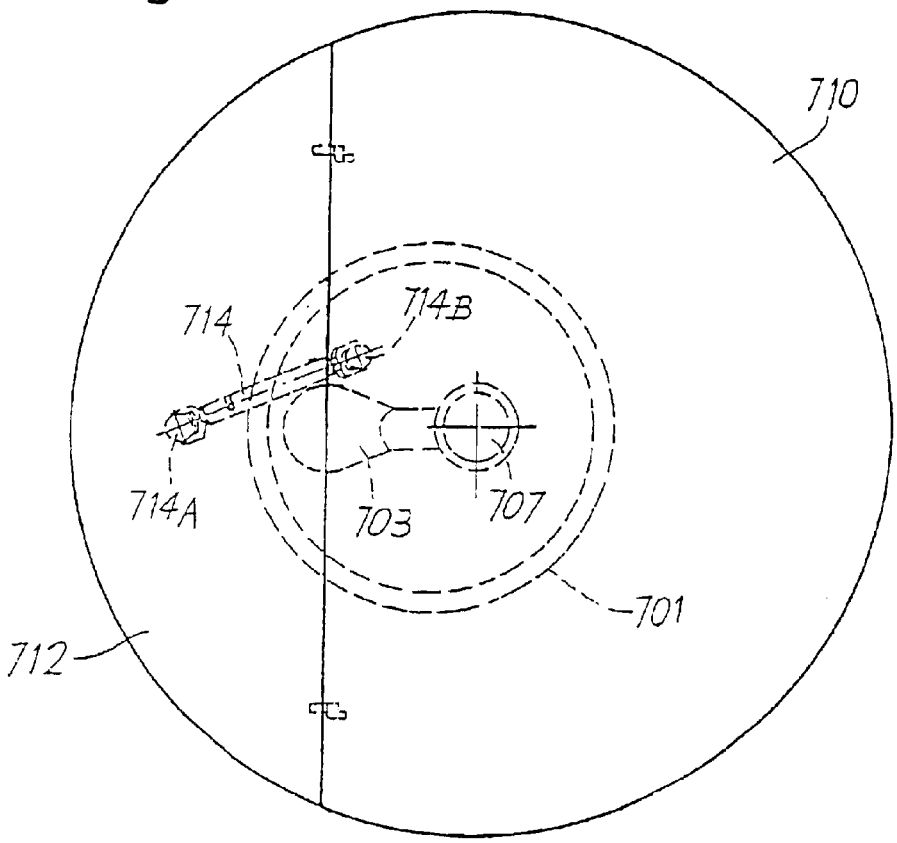
FIGS. 17 through 20 illustrate in plan and lateral view an additional example of table with a side flap, in the reduced and extended configurations.
Figure 18:
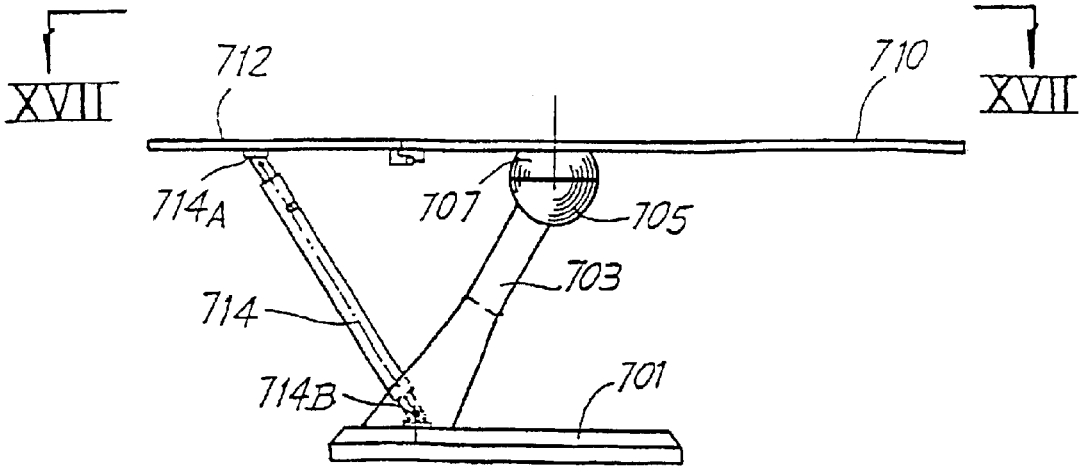
Figure 20:
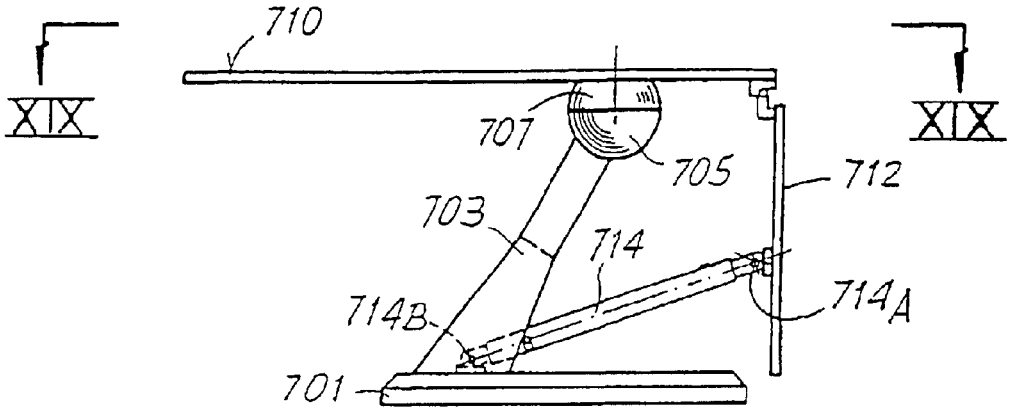
Figure 19:
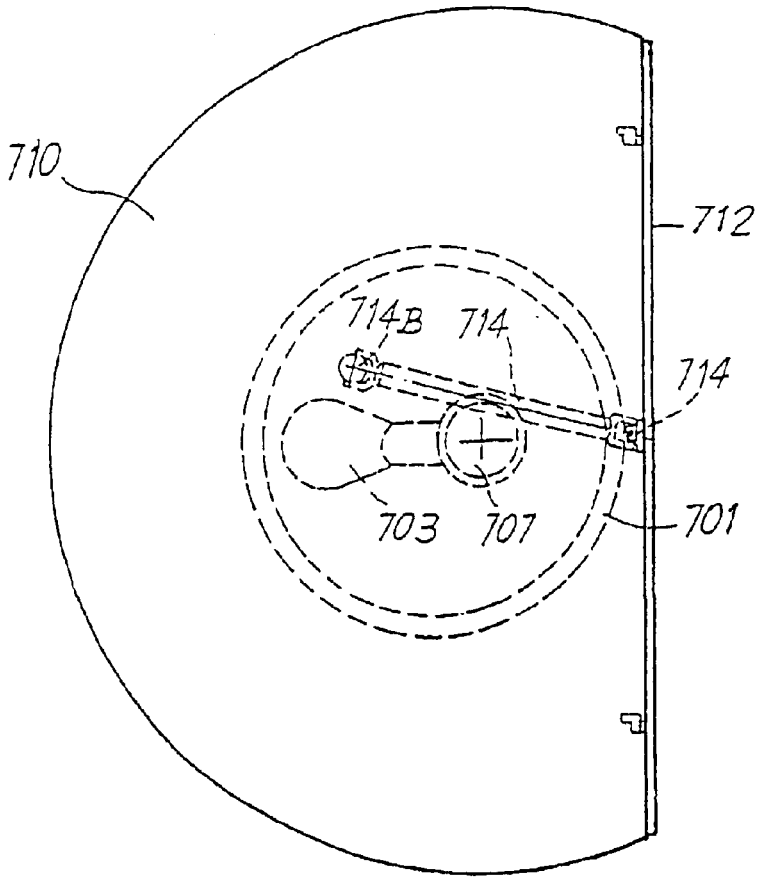

FIGS. 12 through 16 briefly illustrate (in the respective plan views) modified solutions with respect to that shown in FIGS. 1 through 9. FIG. 12 shows a circular table 301 with a single mobile flap 303 which can be excluded by rotation downwards on its straight edge according to the previously described system. FIG. 13 shows a rectangular table 401 with a single mobile flap 403. FIG. 14 shows a rectangular table 501 with two opposite mobile flaps 503. FIGS. 15 and 16 show a square table 601 onto which four sides an equal number of triangular mobile flaps 603 are hinged in the extended configuration and the lowered flap configuration. In these cases, the top of the table is turned on a vertical axis in a central position or in a position which is intermediate between the geometric centers of the useful horizontal development with the flap raised and the flap lowered; the flaps are moved by means of the described apparatus and by the rotation of the top on the axis of the supporting column. In FIGS. 15 and 16, the top 601 turns on the central vertical axis K—K; the ball joints A, B, C, D are fastened to the base and the ball joints X, Y, Z, W are applied under the flaps 603 and shifted to the configuration shown in FIG. 15 and the configuration shown in FIG. 16 and vice versa; the flaps are referred to segments A–X, B–Y, C–Z, D–W.

FIGS. 17 through 20 show a table with a base 701 onto which a slanted support 703 is fastened; a hemispherical expansion 705 on the upper end of said support 703 creates the vertical axis angular constraint for the complementary core 707 which is solidly fastened to the table 710; a flap 712 is articulated to the table. One of the two ball joints 714A, 714B of an articulated strut rod 714 is found under the flap 712, the other ball joint 714B being arranged on the base 701 near the support 703. Functionality is entirely equivalent to that described above.

The flaps, such as 12 hinged to part 10, assume the various described positions without necessarily needing to be materially operated. This means that the flaps can also be made of glass, a material which would be difficult, heavy and delicate to handle directly. The described movement ensures that the glass flaps are safe during shifting.

Naturally, numerous changes can be implemented to the construction and embodiments of the invention herein envisaged without departing from the scope of the present invention. Reference numerals are provided in the annexed claims to facilitate comprehension with reference to the description and the drawing without restricting the scope of protection of the claims.

What is claimed is:

1. A table susceptible of being extended with at least one or more flaps hinged thereto which can be raised from a closed position to a useful horizontal level and lowered again, the table being angularly mobile on a vertical rotation axis with respect to a fixed base;

an articulated rod forming a strut is articulated by means of ball joints under the flap or each flap at a distance from the hinge of the flap to the table and to a support of the base at a distance from the axis of angular mobility of the table; and elastic means being provided to fasten at least a raised position reached by the flap or each flap to the table top;

a fastening unit including a column which is solidly fastened to the top of the table and a sector profile with two notches is solidly fastened interior to the base;

said fastening unit including a pedal device carried by the base and elastically resting on said sector profile for clipping into either one or the other of said two notches providing the end of stroke position in either direction, which define the position on the flap, or flaps, in the coplanar configuration with respect to the table and a position of exclusion.

2. Table according to claim 1, characterized in that said fastening unit stops the table in a position of exclusion in which the flap, or flaps, are slanted downwards and towards the column as not to hinder people sitting at the table in reduced configuration.

3. Table according to claim 2, characterized in that it comprises a spring acting on the sector profile to facilitate reaching each of the fastening closed and raised positions.

4. Table according to claim 1, characterized in that it comprises a spring acting on the sector profile to facilitate reaching each of the closed and raised positions.

5. A table susceptible of being extended with at least one or more flaps hinged thereto which can be raised from a closed position to a useful horizontal level and lowered again, the table being angularly mobile on an vertical rotation axis with respect to a fixed base;

an articulated rod forming a strut being articulated by means of ball joints under the flap or each flap at a distance from the hinge of the flap to the table and to a support of the base at a distance from the axis of an angular mobility of the table; and elastic means being provided to fasten with a lock at least the raised position reached by the flap or each flap to the table top, and in which the rod or each rod on each of its two ends has with two ball joint points with cardan type articulation, characterized in that each rod also comprises an articulation which is coaxial to the rod itself.

6. Table according to claim 5, characterized in that each ball joint is a cardan joint, a first cardan joint comprises a first axis which is orthogonal to the flap, a second cardan joint includes a first axis which is orthogonal to the top of the table, each of said first and second cardan joints include a second axis orthogonal to a respective first axis and orthogonal to an axis of the rod.

7. An expanding table arrangement comprising:

a base;

a tabletop rotatably mounted on said base about a rotation axis;

a flap hinged to said table top and movable between closed and opened positions;

a flap joint mounted on said flap at a distance from said tabletop;

a base joint mounted on said base at a distance from said rotation axis;

an articulated rod with ends connected to said flap joint and said base joint in a cardan type articulation, said rod including a rod articulation connection between said ends, said rod articulation being substantially coaxial with said rod;

a locking unit locking said flap in said opened position.

8. An arrangement in accordance with claim 7, further comprising:

a column rotationally fixed to said tabletop, said column being arranged inside said base;

a sector profile rotationally fixed to said column, said sector profile defining two locking portions;

said locking unit including a locking part arranged on said base, said locking part being selectively connectable to said locking portions of said sector profile to lock said tabletop in one of said opened and closed positions.

9. An arrangement in accordance with claim 8, wherein:

said locking unit includes a spring biasing one of said locking portions toward said locking part.

10. An arrangement in accordance with claim 8, wherein:

said locking unit includes a spring selectively biasing said locking portions to lock with said locking part.

11. An arrangement in accordance with claim 8, wherein:

said locking part is a pedal device.

12. An arrangement in accordance with claim 7, wherein:

said closed position of said flap arranges said flap slanted downwards and towards said column so as not to hinder people sitting at the table arrangement.

said opened position of said flap arranges said flap substantially coplanar with said tabletop.

13. An arrangement in accordance with claim 7, wherein:

gravity biases said flap into a dead position between said opened and closed positions;

said locking unit includes a spring selectively biasing said flap away from said dead position.

14. An arrangement in accordance with claim 7, wherein:

said articulated rod has a longitudinal axis;

said flap joint is a cardan flap joint with a first flap axis substantially orthogonal to a plane of said flap, said cardan flap joint includes a second flap axis substantially orthogonal to said first flap axis and said longitudinal axis of said articulated rod;

said base joint is a cardan base joint with a first base axis substantially orthogonal to a plane of said tabletop, said cardan base joint includes a second base axis substantially orthogonal to said first base axis and said longitudinal axis of said articulated rod.

* * * * *